US005682020A

United States Patent [19]

Oliveira

[11] Patent Number: 5,682,020

[45] Date of Patent: Oct. 28, 1997

[54] SEALING OF HEARING AID TO EAR CANAL

[76] Inventor: Robert J. Oliveira, 200 Crestview Dr., Maplewood, Ramsey County, Minn. 55119

[21] Appl. No.: 668,021

[22] Filed: Jan. 17, 1996

Related U.S. Application Data

[63] Continuation of Ser. No. 315,436, Sep. 30, 1994, abandoned, which is a continuation-in-part of Ser. No. 53,818, Apr. 29, 1993, Pat. No. 5,401,920, which is a continuation of Ser. No. 803,576, Dec. 9, 1991, abandoned.

[51] Int. Cl.[6] ..... H04R 25/02

[52] U.S. Cl. ..... 181/130; 181/135

[58] Field of Search ..... 181/130, 131, 181/135; 381/68.6, 68, 69; 128/864, 865, 867

[56] References Cited

U.S. PATENT DOCUMENTS

| | | | |
|---|---|---|---|
| 2,545,731 | 2/1951 | French | 181/23 |
| 2,934,160 | 3/1960 | Touson | 181/23 |
| 3,505,999 | 4/1970 | Harvey et al. | 128/152 |
| 4,006,796 | 2/1977 | Coehorst | 181/130 |
| 4,130,741 | 12/1978 | Gottlieb | 181/135 |
| 4,375,016 | 2/1983 | Harada | 181/135 |
| 4,472,342 | 9/1984 | Carr | 264/554 |
| 4,617,429 | 10/1986 | Bellafiore | 179/107 |
| 4,724,922 | 2/1988 | Kalayjian | 181/135 |
| 4,869,339 | 9/1989 | Barton | 181/130 |
| 5,002,151 | 3/1991 | Oliveira et al. | 181/130 |
| 5,031,219 | 7/1991 | Ward et al. | 381/68.6 |
| 5,201,007 | 4/1993 | Ward et al. | 381/68.6 |

OTHER PUBLICATIONS

Phillips Hearing Instrument publication dated Jun. 1994, entitled B.S.T.—a Revolution in Perity mpanic Application.

*Primary Examiner*—Khanh Dang
*Attorney, Agent, or Firm*—Richard E. Brink

[57] ABSTRACT

A device for providing a seal between a sound-blocking or sound-transmitting device, especially an "in the ear" hearing aid, and the ear canal into which it is inserted. This device comprises a layer of polymeric foam, especially retarded recovery foam, that is applied to at least a portion of the canal-contacting surface of the hearing aid. A normally tacky and pressure-sensitive adhesive bonds the foam to the hearing aid, thereby rendering the device easily removable and replaceable by the user. In a preferred embodiment the hearing aid is sealed to the bony portion of the ear canal.

7 Claims, 2 Drawing Sheets

SEALING OF HEARING AID TO EAR CANAL

CROSS-REFERENCE TO RELATED APPLICATIONS

This application is a continuation of U.S. Ser. No. 08/315,436, filed Sep. 30, 1994, now abandoned, which is a continuation-in-part of U.S. Ser. No. 08/053,818, filed Apr. 29, 1993, now U.S. Pat. No. 5,401,920, which in turn is a continuation of U.S. Ser. No. 07/803,576, filed Dec. 9, 1991, now abandoned.

BACKGROUND OF THE INVENTION

This invention relates to means for and methods of providing improved sealing between a sound transmtting or sound-blocking device, especially an "in the ear" hearing aid, and the ear canal in which it is mounted.

The human ear canal is made up of a cartilaginous portion and, in the portion adjacent the ear drum, a bony, or osseous, portion, the transition from cartilaginous to osseous occurring first in the superior and posterior portions of the canal. Until quite recently, most "in the ear" hearing aids were positioned in the cartilaginous portion. Although the bony portion of the canal is hard and does not flex, the dimensions of the cartilaginous portion can change during mastication or conversation, making it difficult to maintain a seal between the canal and a hearing aid positioned therein. Unless an effective seal is maintained, an annoying feedback problem is frequently encountered by hearing aid wearers while they are dining with friends or talking on the telephone, times during which the anterior wall of the ear canal (and, to a lesser extent, the inferior wall of the canal) may move in and out. The common practice of custom making the shell of the hearing aid to fit each individual's ear canal is an incompletely successful attempt to cope with this problem. Previous attempts to maintain an effective seal have included surrounding the inserted portion of the hearing aid with an oil- or water-filled capsule (U.S. Pat. No. 2,934,160), a flexible bag into which fluid is pumped (U.S. Pat. No. 3,505,997, or a plastic pouch filled with a sluggishly moving jelly-like paste (U.S. Pat. No. 4,006,796). Attempts have also been made to provide an effective seal between the hearing aid and the ear canal by slipping a foam ring (e.g., ER-13R "E-A-R-RING," available from Etymotic Research, Elk Grove Village, Ill., USA) over the distal portion of the hearing aid. The manufacturer suggests using a drop of a permanent adhesive (e.g., tetrahydrofuran, which is presumably a solvent for the plastic body of the hearing aid), to hold the foam ring in place, but such an adhesive makes it difficult to remove the ring after it becomes soiled. In the absence of adhesive, these rings have been known to remain in the ear after the hearing aid has been removed, thus making it difficult to retrieve them.

Other attempts to achieve an effective seal between a hearing aid and the ear canal are shown in U.S. Pat. No. 5,002,151, where, in one embodiment, a relatively thick tapered foam sleeve surrounds and is adhered to a "duct," which in turn is mounted on a hearing aid that is especially designed to accommodate it. In another embodiment, a thick annular foam sleeve surrounds a slender tapered hollow "projection" extending from the hearing aid, one end being adhered to a flange on the projection to hold it in place. A scrim is adhered to the distal end of the sleeve to keep the projection from extending beyond the sleeve. When the foam becomes soiled, the entire duct-sleeve assembly of the first embodiment must be removed and discarded and a new duct-sleeve assembly installed. In the second embodiment, only the soiled sleeve is removed and discarded. In either case, the ability to fit only a specially designed hearing aid makes it impossible to install the duct-sleeve assembly or the annular foam sleeve on a conventional hearing aid. A further disadvantage of the structure disclosed in U.S. Pat. No. 5,002,151 is that it occupies space that would otherwise be available for the electronic components housed in the hearing aid body.

In recent times, hearing aids that penetrate deeper into the ear canal, extending into the bony portion, have been developed. One example of such hearing aids is shown in U.S. Pat. No. 5,201,007, where a slender sound conduction tube, much smaller in cross-section than the ear canal, transmits sound to the bony portion of the ear canal, where a flexible flanged tip forms a seal. One advantage said to be possessed by this device is the effective reduction of the amount of amplified sound that can travel outwardly and feed back into the microphone of the hearing aid. Other examples of hearing aids that potentially involve a seal in the bony portion of the canal are the increasingly popular "CIC" (completely in canal) devices, which are small and essentially invisible to other persons. CIC devices lack support provided by the concha of the external ear and are thus inherently less stable than the more conventional hearing aids. Like the device of U.S. Pat. No. 5,201,007, the CIC devices require maximizing the open passage between the seal and the external portion of the ear to minimize the occlusion effect that results from the transmission of low frequencies generated by the voice of the hearing aid wearer through the temporal bones to the ear canal, an effect that causes the speaker to experience a "hollering down a rain barrel" sensation. Phillips Hearing Instruments is said to have developed a so-called "B.S.T." (Bony Seal Tip) that is integral with hearing aids of this type, apparently consisting of a flexible-walled generally cup-shaped device having a diameter somewhat greater than that of the bony portion of the ear canal, with the open part of the cup facing away from the ear drum.

BRIEF DESCRIPTION

The present invention provides excellent sealing between an "in the ear" hearing aid and the ear canal in which it is positioned, e.g., between the hearing aid and the mobile anterior cartilaginous portion of the canal. (The term "sealing" as used in this context means that no air gap develops between the hearing aid and the anterior wall of the canal when it moves in and out because of jaw movement). This sealing is achieved by temporarily and removably adhering a resilient foam material to at least the surface of the hearing aid at that portion of the hearing aid confronting the anterior wall of the canal. When, however, the hearing aid is of the type that extends into the bony portion of the ear canal (e.g., of either the CIC type or the type shown in U.S. Pat. No. 5,031,219), it is important to avoid irritation of the sensitive skin in that area. In accordance with the invention, this can be accomplished by making certain that the perimeter of the hearing aid in the bony portion is somewhat less than the internal perimeter of the ear canal at that point. In order to provide an effective seal between the hearing aid and the ear canal, it is then desirable to install foam material that completely surrounds the inwardly extending portion of the hearing aid just beyond the location where the transition from cartilaginous to bony occurs. To facilitate insertion of the hearing aid, the resilient foam material is preferably characterized by displaying retarded recovery when compressed. When such a foam is used, it may be compressed to permit easy insertion of the hearing aid, after which it will slowly expand to fill the ear canal. In most instances, foam material having a thickness of 0.8 mm to 3.2 mm has been found to be especially satisfactory. In accordance with the invention, the foam material can be easily installed, removed, and replaced by any normal user.

The method of providing better sealing between an "in the ear" hearing aid and the ear canal in which it is mounted comprises using a normally tacky and pressure-sensitive adhesive to temporarily and removably adhere a resilient foam material (especially a foam characterized by retarded recovery) to at least that surface of the hearing aid confronting the anterior wall of the ear canal.

The invention also provides a hearing aid having a distal portion for positioning in a human ear canal to a depth sufficient to extend into the bony portion thereof, the distal portion being surrounded and removably adhered to by a resilient foam material, especially a retarded recovery foam, so as to provide an acoustic seal between the bony portion and the hearing aid. In order to minimize the occlusion effect mentioned previously, there should be no additional seal at the mouth of the ear canal. Even in those types of hearing aid where the concha of the ear is filled with an individually molded supporting member, an air passage will be available along the lower portion of the ear through the tragal notch, which is not occluded by the supporting member.

BRIEF DESCRIPTION OF THE DRAWING

Understanding of the invention will be enhanced by referring to the accompanying drawing, in which like numbers refer to like parts in the several views, and in which.

DETAILED DESCRIPTION

Figure 1:
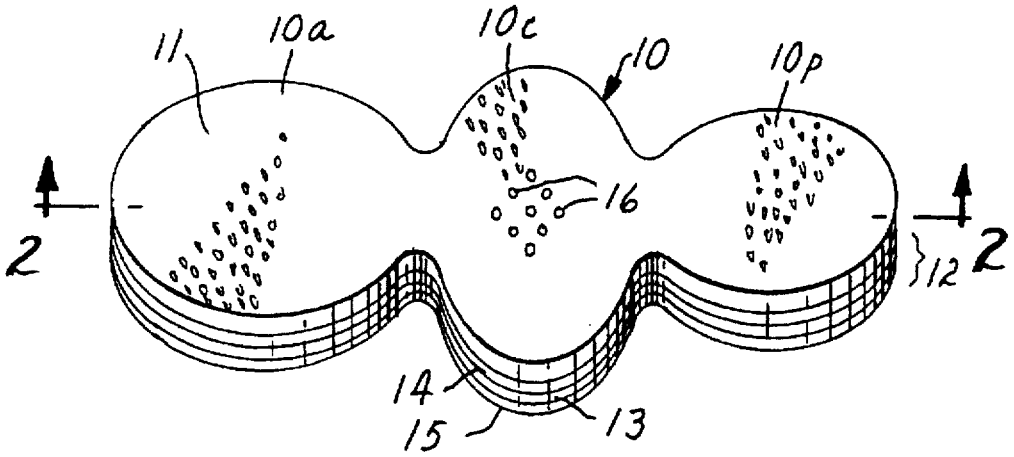
FIG. 1 is a greatly enlarged perspective view of one embodiment of a sealing device of the invention.
Figure 2:
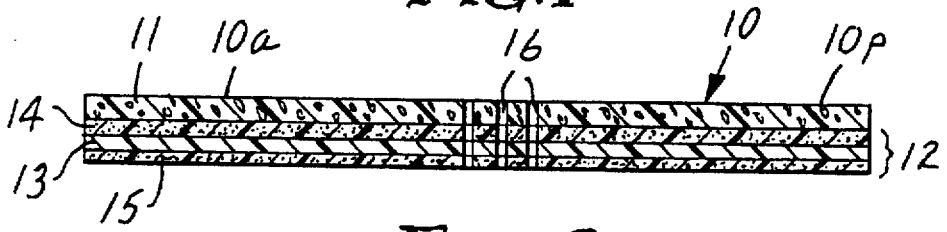
FIG. 2 is a cross-sectional view of the sealing device of FIG. 1, taken along section line 2—2, looking in the direction of the arrows.
Figure 6:
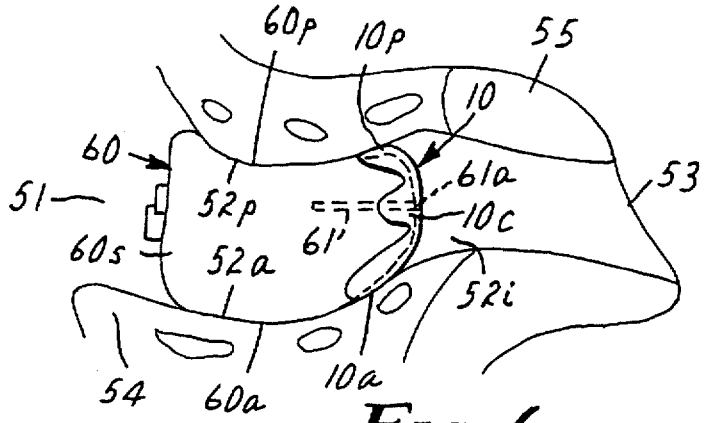
FIG. 6 is an enlarged cross-sectional view of the ear canal of a right ear, taken from above, an "in the ear" hearing aid positioned in the cartilaginous portion of the canal and sealed thereto by the sealing device of FIG. 1, the superior wall of the canal being removed for clarity.

In FIGS. 1 and 2, sealing device 10 comprises thin, compressible, resilient, soft membrane layer 11 of polymeric foam, preferably a retarded recovery foam. Sealing device 10 in turn comprises anterior and posterior attaching lobes 10*a*, 10*p*, and central lobe 10*c*. Laminated to the lower surface of foam membrane layer 11 is double-coated tape 12, comprising thin (about 0.0015-inch, or 6-micrometer) polyethylene film 13 and pressure-sensitive adhesive layers 14, 15. Polyethylene film 13 is helpful in imparting structural integrity to sealing device 10, facilitating removal of device 10 in one piece from a hearing aid on which it is installed. The central portion of lobe 10*c* is provided with holes 16 to permit the transmission of sound. This embodiment of the invention is thus both simple and economical to make. As is shown in FIG. 6, pressure-sensitive adhesive 15 serves to affix sealing device 10 to a hearing aid, with central portion 10*c* positioned over sound outlet port 61*a*. When the hearing aid body 60 is formed from an acrylate, as is typically the case, pressure-sensitive adhesive 15 is preferably a hypoallergenic acrylate. If, of course, hearing aid body 60 is formed from a cast silicone, pressure-sensitive adhesive 15 is preferably selected from a material having a strong affinity for silicone surfaces. The same type of reasoning will apply if hearing aid body 60 is formed from some other polymer.

Figure 3:
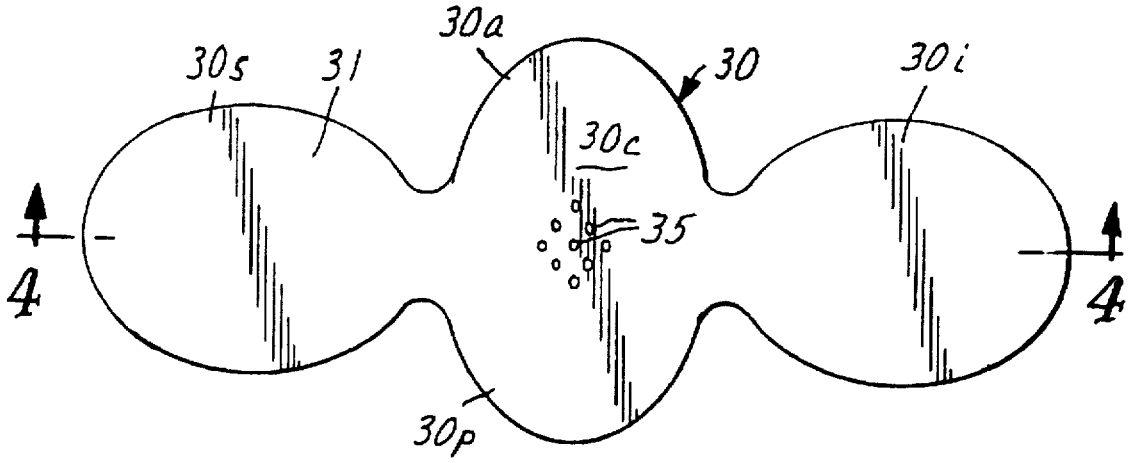
FIG. 3 is a greatly enlarged plan view of another embodiment of a sealing device of the invention.
Figure 4:
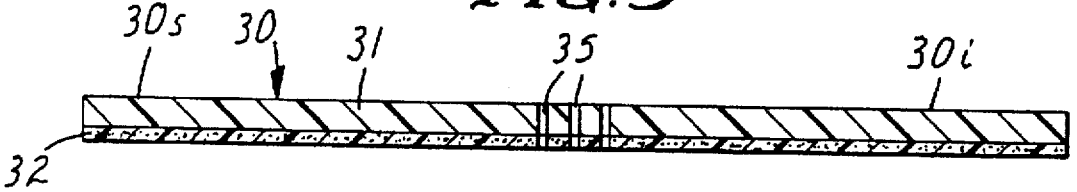
FIG. 4 is a cross-sectional view of the sealing device of FIG. 3, taken along section line 4—4, looking in the direction of the arrows.

In FIGS. 3 and 4, sealing device 30, which superficially resembles sealing device 10 but differs significantly therefrom, comprises a layer of retarded recovery foam 31 coated with a layer of pressure-sensitive adhesive 32. Sealing device 30 comprises central portion 30*c*, through which sound-transmitting holes 35 extend. Extending from central portion 30*c* are anterior attaching lobe 30*a*, posterior attaching lobe 30*p*, superior attaching lobe 30*s*, and inferior attaching lobe 30*i*.

Figure 5:
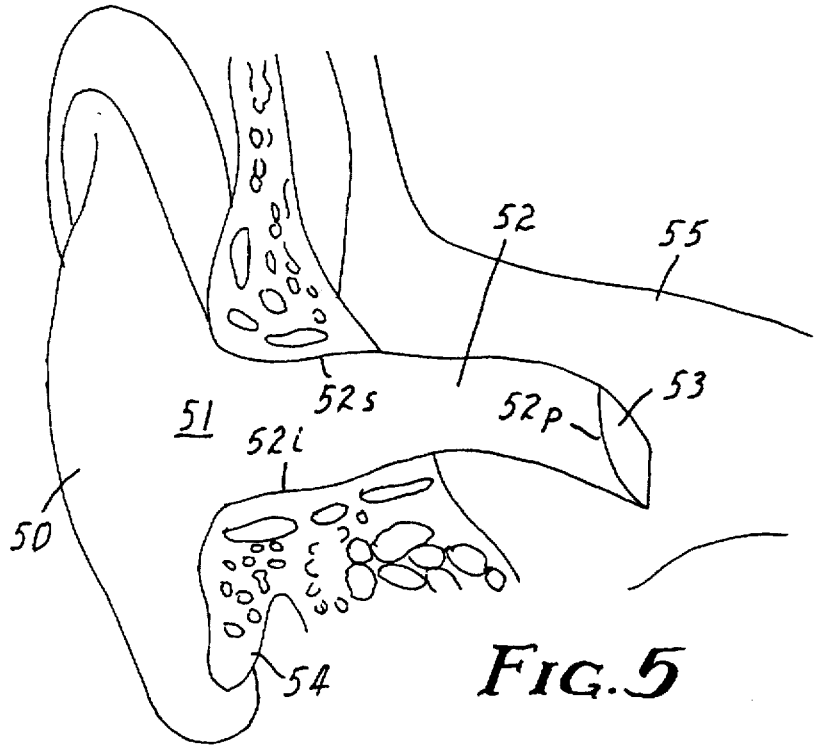
FIG. 5 is an enlarged front cross-sectional view of the right ear of a human being, showing the concha of the external ear, the ear canal, and surrounding structure, the anterior wall of the canal being removed for clarity.
Figure 7:
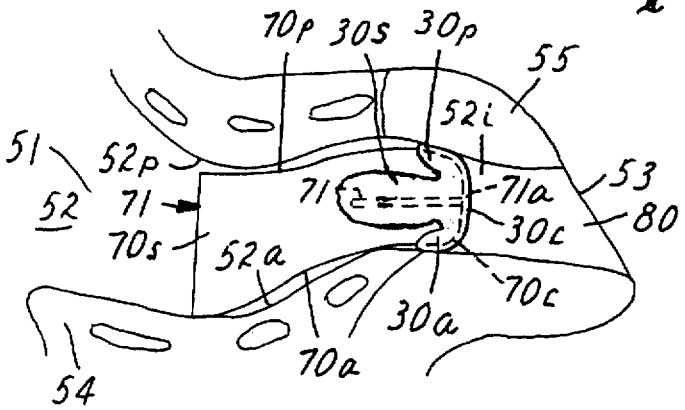
FIG. 7 is a view similar to that of FIG. 6 but showing a "CIC" hearing aid positioned in the ear canal and sealed to the bony portion thereof by means of the sealing device of FIG. 3.

Turning next to FIGS. 5–7, from concha 50 aperture 51 leads into ear canal 52, the latter terminating at tympanic membrane, or ear drum, 53. Ear canal 52 is defined by cartilaginous portion 54 and bony portion 55, both of which are covered by skin. The skin covering the bony portion is smooth, thin, and sensitive, while the skin covering the cartilaginous portion is thicker, and less sensitive, having a more porous surface from which cerumen escapes, cerumen being a mixture of sloughed off dead skin and exuded wax and sebaceous oil. Individuals differ considerably, but the portion of canal 52 defined by cartilaginous portion 54 may change in dimension as the anterior wall moves in and out during mastication or conversation, whereas the portion of canal 52 defined by bony portion 55 is essentially fixed in dimension.

In FIG. 6, hearing aid 60, having anterior surface 60*a*, posterior surface 60*p*, superior surface 60*s* and inferior surface (not visible in the drawing), contacting, respectively, anterior wall 52*a*, posterior wall 52*p*, superior wall 52*s* (not shown), and inferior wall 52*i* of ear canal 52 which they contact, is positioned in the cartilaginous portion 54 of ear canal 52. Hearing aid 60 includes the conventional battery, microphone, amplifier, and speaker (none of which are shown), with open-ended sound-transmitting tube 61 extending from the speaker to the inner end of hearing aid 60 and terminating in outlet port 61*a*. Attached to hearing aid 60 is sealing device 10, central portion 10*c* overlying outlet port 61*a* and lobe 10*a* adhered to anterior surface 60*a*. Lobe 10*p* is adhered to hearing aid surface 60*p*. In any event, lobe 10*a* contacts anterior surface 52*a* of ear canal 52, adjusting to its changing shape and forming a seal that helps maintain the location of hearing aid 60 and, more importantly, prevents the development of a gap between hearing aid 60 and anterior wall 52*a*.

In FIG. 7, hearing aid 70 is significantly miniaturized and positioned in ear canal 52, with its inner end extending into bony portion 55. Sound-transmitting tube 71 extends from the loudspeaker (not shown) incorporated in hearing aid 70 to outlet port 71*a*. Attached to hearing aid 70 and overlying its inner end 70*c* is sealing member 30. Central portion 30*c* extends over end 70*c* in every direction so as to form an acoustic seal with bony portion 55 of canal 52. Resonant cavity 80 is defined by the seal, the bony portion 55 of canal 52, and tympanic membrane 53. Lobes 30*s* and 30*i* (not visible in FIG. 7) are adhered respectively to upper surface 70*s* and lower surface 70*i* (not visible in FIG. 7) of hearing aid 70, extending into cartilaginous portion 54. This arrangement provides for holding the inner end of hearing aid 70 in fixed position in canal 52, lobes 30*p* and 30*a* respectively contacting posterior wall 52*p* and anterior wall 52*a* of canal 52 and helping maintain stability. Since the vertical dimensions of ear canal 52 are not significantly affected by movement of the anterior wall of ear canal 52, it is desirable for lobes 30*s* and 30*i* to be relatively larger in order to contact, respectively the cartilaginous portion of the stable superior surface 52*s* and essentially stable inferior surface 52*i* of ear canal 52, helping to maintain hearing aid 70 at a constant location. It will be noted that hearing aid 70 is smaller in cross-section than ear canal 52, thereby permitting passage of sound between opening 51 and the location of the seal.

To facilitate insertion of a hearing aid deep into an ear canal, especially where it extends into the bony portion, it is preferable to reduce the perimeter of the hearing aid and to form sealing material 31 from retarded recovery foam. When such foam is used, the sealing device can be installed on the hearing aid and the foam squeezed to compress it to a thickness providing for easy insertion into the ear canal, after which the foam slowly recovers sufficient thickness to seal smoothly against the ear canal. Depending on the difference in the periphery of the hearing aid and the inner circumference of the ear canal, it appears that foam having a thickness of 0.8 mm to 3.2 mm is very suitable.

The human ear canal provides a relatively hostile environment, and it is essential that the sealing means be capable of coping with it. The process of inserting or removing a hearing aid into the ear canal inevitably contaminates it with cerumen, and it is thus highly desirable that the sealing means not only occupy minimal space but also be capable of easy replacement by the wearer of the hearing aid. It is believed that, for the first time, the present invention provides such a sealing means.

It will be appreciated that, although sealing devices having two and four lobes have been described, the invention is not limited to such structures; for example, a sealing device having a multilobal shape would also function satisfactorily. It is also possible that a highly conformable oversize annulus or thimble-shaped sealing device might be usable.

Numerous ways of reducing the cross-section of hearing aid 70 will readily occur to those skilled in the art. For example, some form of the device shown in U.S. Pat. No. 5,031,219 may be feasible, although the slender tube described is subject to breakage. A hearing aid body is conventionally made by taking an impression of the prospective wearer's ear canal, making a female mold from the impression, and then casting a suitable material in the female mold. The external surface of a hearing aid body made in this conventional manner may be abraded to reduce its dimensions. Alternatively, the portion of the female mold corresponding to the canal portion of the ear may be coated with a material to reduce its dimensions before the hearing aid body is cast.

One of the most important uses contemplated for the invention is application to CIC (completely in canal) hearing aids, which require a lower level of amplification for a given perception of sound compared to shallow fitting hearing aids and can provide superior feedback control. It will readily be appreciated, however, that the invention also lends itself to use with ITC (in the canal) hearing aids, as well as both ITE (in the ear) hearing aids and BTE (behind the ear) hearing aids having sufficiently reduced dimensions in the canal area to allow a space that will communicate with an opening made in the tragal notch area.

It is also contemplated that a family of more or less standard size hearing aids, the smallest of which is smaller in cross section than the smallest normal ear canal, may be utilized, thereby reducing cost of manufacture. If such a hearing aid is employed, one need only select a sealing device of appropriate thickness to fill the ear canal of the individual to be fitted with the hearing aid. It is further contemplated that a universal size of ear plug could be designed to accommodate sealing devices of the type described herein, adhering a sealing means of thickness appropriate to the dimensions of the wearer's ear canal, following the same design principles as used for hearing aids. In other words, the present invention lends itself not only to sound transmission or amplification equipment such as telephone ear pieces, ear pieces for radio, cassette players, and similar equipment but also to sound blocking equipment.

What is claimed is as follows:

1. A method of providing better sealing between a device that either blocks or permits the transmission of sound and the ear canal in which said device is mounted, said ear canal having anterior, posterior, superior and inferior walls, said ear canal also having a cartilaginous portion and a bony portion, wherein a resilient foam material is positioned between the device and the ear canal, comprising using a normally tacky and pressure-sensitive adhesive to temporarily and removably adhere the resilient foam material to the surface of the device that confronts the anterior wall of the ear canal when said device is inserted in said ear canal, and inserting the device into the user's ear canal.

2. The method of claim 1 wherein the resilient foam material is characterized by retarded recovery.

3. The method of claim 2 wherein the foam material has a thickness of 0.8 mm to 3.2 mm.

4. A device for mounting in a human ear to either block the transmission of sound or transmit amplified sound, comprising a body that has superior, inferior, anterior and posterior surfaces when inserted in the ear canal and a smaller cross section than a cross section of the human ear canal into which said body is inserted, said ear canal having superior, inferior, anterior and posterior walls, said body having a layer of retarded recovery foam adhered thereto by a normally tacky and pressure-sensitive adhesive, wherein the layer of retarded recovery foam is adhered directly to said surfaces and surrounds a portion of said device to seal said ear canal so that the superior, inferior, anterior and posterior surfaces of the device confront the corresponding superior, inferior, anterior and posterior walls of the ear canal, whereby said foam layer is readily removed and replaced.

5. The invention of claim 4 wherein the foam material has a thickness of 0.8 mm to 3.2 mm.

6. The invention of claim 5 wherein the device is a hearing aid of the CIC (completely in canal) type.

7. The invention of claim 6 wherein the resilient foam material is configured so as to have elongated lobes for attaching, respectively to the superior and inferior surfaces of the hearing aid when inserted in the ear canal, permitting said lobes to extend into the cartilaginous portion of the canal so as to contact, respectively, the superior and inferior walls of the canal, thereby helping to hold the hearing aid in fixed position after it has been installed.

* * * * *